US007708261B2

(12) United States Patent
Cullen

(10) Patent No.: US 7,708,261 B2
(45) Date of Patent: May 4, 2010

(54) CARPENTER'S SQUARE SECURING APPARATUS

(76) Inventor: Dennis R Cullen, 1426 Blackthorn Dr., Glenview, IL (US) 60025

( * ) Notice: Subject to any disclaimer, the term of this patent is extended or adjusted under 35 U.S.C. 154(b) by 180 days.

(21) Appl. No.: 11/891,267

(22) Filed: Aug. 10, 2007

(65) Prior Publication Data

US 2009/0039214 A1 Feb. 12, 2009

(51) Int. Cl.
*B25B 5/14* (2006.01)

(52) U.S. Cl. ..... 269/41; 269/900; 269/289 R; 248/176.1

(58) Field of Classification Search ..... 269/41, 269/289 R, 302.1, 900; 248/176.1
See application file for complete search history.

(56) References Cited

U.S. PATENT DOCUMENTS 4,101,049 A * 7/1978 Wallace et al. ..... 206/521.1
5,907,989 A * 6/1999 Sie et al. ..... 83/762
6,109,345 A * 8/2000 Giacomel ..... 165/185
D432,352 S * 10/2000 Giacomel ..... D7/387
6,206,356 B1 * 3/2001 Beloff ..... 269/289 R
6,742,580 B1 * 6/2004 Giacomel ..... 165/185
7,066,457 B2 * 6/2006 Gerritsen et al. ..... 269/6
2004/0144903 A1 * 7/2004 Cherubini et al. ..... 248/231.71
2009/0039214 A1 * 2/2009 Cullen ..... 248/176.1

* cited by examiner

*Primary Examiner*—Lee D Wilson
(74) *Attorney, Agent, or Firm*—Justin Lampel

(57) ABSTRACT

The present invention generally relates to a securing apparatus for a carpenter's square and a method for using the same. The apparatus is especially suitable for securing at least two planar surfaces in a fixed position. More specifically, the apparatus may allow a user to secure at least two planar surfaces in a fixed position to, for example, perform work on the planar surfaces. The present invention allows a user to easily secure a clamp onto a carpenter's square.

7 Claims, 3 Drawing Sheets

CARPENTER'S SQUARE SECURING APPARATUS

BACKGROUND OF THE INVENTION

The present invention generally relates to a securing apparatus for a carpenter's square and a method for using the same. The apparatus is especially suitable for securing at least two planar surfaces in a fixed position. More specifically, the apparatus may allow a user to secure at least two planar surfaces in a fixed position to, for example, perform work on the planar surfaces. The present invention allows a user to easily secure a clamp onto a carpenter's square.

There are a number of different apparatuses that have been invented to temporarily secure to surfaces together in order to perform work on the surfaces. These inventions include clamps, toggle linkage gripping tools and locking pliers. These tools generally have a few different functions such as, gripping a member so that it can be manipulated or holding two large members, such a wood frame members, at right angles before they are secured together.

U.S. Patent No.: to Johnson relates to an attachment for a carpenter's square which permits the carpenter's square to be self supporting on a flat, horizontal surface. The attachment has an elongated support bar with two clips which may be inserted over a blade of a carpenter's square. This attachment, when inserted on the inner edge of the carpenter's square, facilitates the scribing of a right-angle line to a rounded edge and when placed on an outer edge, permits the square to be free standing.

However, these existing devices fail to provide the benefits of the present invention. More specifically, theses existing devices fail to hold a carpenter's square in a secure position while work is performed on planar surfaces attached to the carpenter's square.

A need, therefore, exists for an improved apparatus for securing at least two planar surfaces in a secure position. In addition, an improved apparatus is needed which can be used in association with common tools, such as a carpenter's square.

SUMMARY OF THE INVENTION

The present invention generally relates to a securing apparatus for a carpenter's square and a method for using the same. The apparatus is especially suitable for securing at least two planar surfaces in a fixed position. More specifically, the apparatus may allow a user to secure at least two planar surfaces in a fixed position to, for example, perform work on the planar surfaces. The present invention allows a user to easily secure a clamp onto a carpenter's square.

An advantage of the present invention is to provide a securing apparatus which can secure a carpenter's square to a planar surface.

An advantage of the present invention is to provide a securing apparatus which is easily transported.

Another advantage of the present invention is to provide a securing apparatus which may be used multiple times.

A further advantage of the present invention is to provide a securing apparatus which may be used to secure a carpenter's square of various lengths.

For a more complete understanding of the above listed features and advantages of the carpenters square securing apparatus, reference should be made to the following detailed description of the preferred embodiments and to the accompanying drawings. Further, additional features and advantages of the present invention are described in, and will be apparent from, the detailed description of the preferred embodiments and from the drawings.

DETAILED DESCRIPTION OF THE PREFERRED EMBODIMENTS

The present invention generally relates to a securing apparatus for a carpenter's square and a method for using the same. The apparatus is especially suitable for securing at least two planar surfaces in a fixed position. More specifically, the apparatus may allow a user to secure at least two planar surfaces in a fixed position to, for example, perform work on the planar surfaces. The present invention allows a user to easily secure a clamp onto a carpenter's square.

During construction of furniture or other objects made from, for example, wood, it is often important to secure two planar surfaces together. Often the two planar surfaces are secured into a substantially perpendicular position to act as, for example a corner of the object. To accomplish this, carpenters often utilize clamps, levels, rulers and even tape to secure the surfaces while work is performed on the surfaces. For example, it is common to place glue on the side of one planar surface and then to clamp the two planar surfaces in a perpendicular position while the glue permanently secures the surfaces together. Often the carpenter also uses nails and or screws for reinforce the glue. The clamps, levels, rulers and/or tape are then removed after the planar surfaces are secured together. It is common for a person to use a carpenters square to measure (or secure) the angle of two or more panels that are to be secured together. Usually the panels are secured at ninety degree angles. The present apparatus allows the user to automatically obtain the desired angle between the two or more panels.

Figures 1, 2:
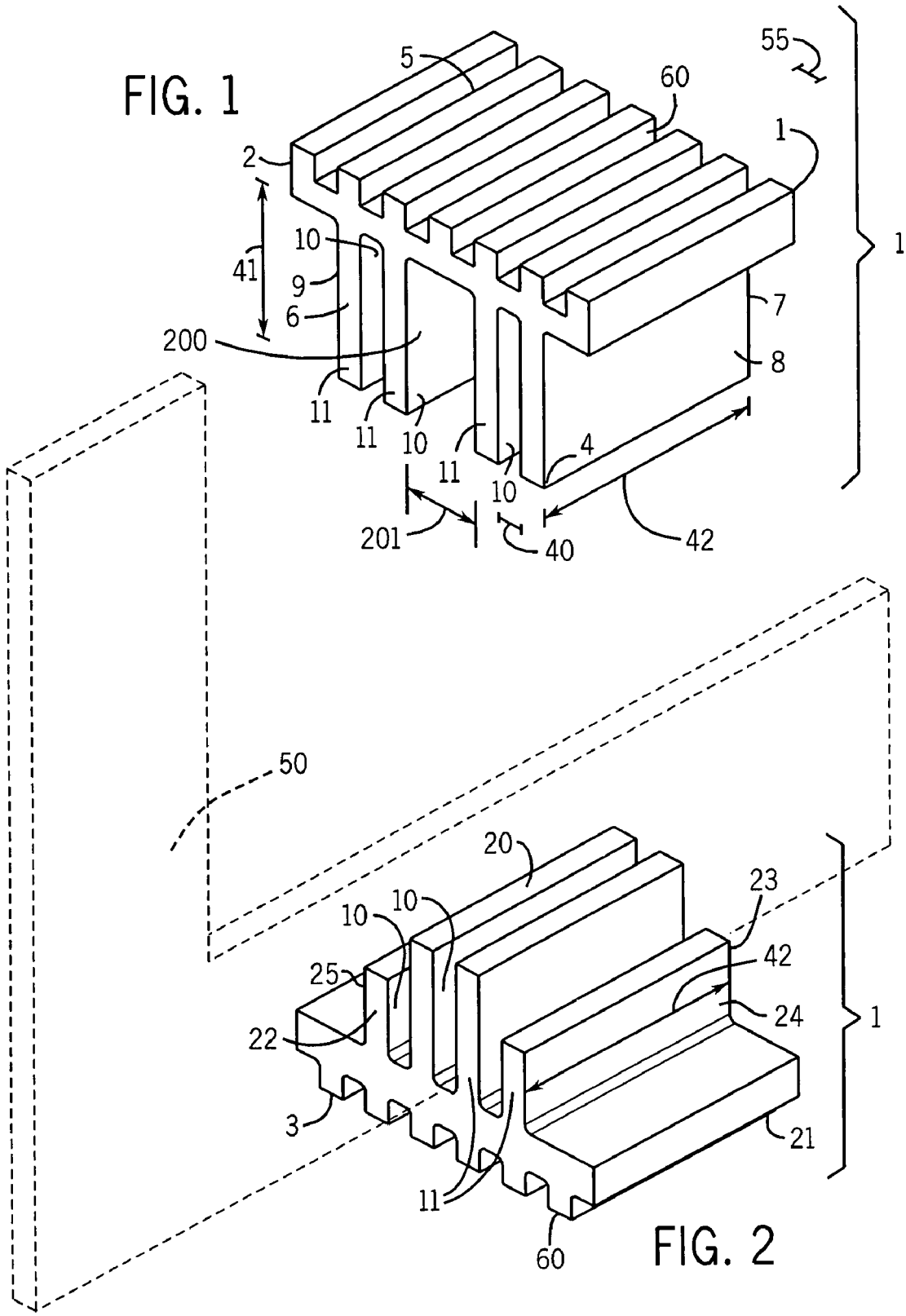
FIG. 1 illustrates a side perspective view of a second unit of the securing apparatus of the present invention.
FIG. 2 illustrates a side perspective view of the present invention wherein a first unit is used to secure a carpenters square.

Referring now to the drawings wherein like numerals refer to like parts, FIGS. 1 and 2 generally illustrates a carpenter's square securing apparatus 1. The securing apparatus 1 may have a first unit 2 and a second unit 3. The first unit 2 may have a top side 4, a bottom side 5, a front 6, a back 7, a first side 8 and a second side 9. Further, the first unit 2 may have a plurality of slots 10 divided by a plurality of securing panels 11. The plurality of slots 10 and the plurality of securing panels 11 may be substantially planar and substantially parallel to each other. Further the two exterior most plurality of securing panels 11 may act as the first side 8 and the second side 9 of the first unit 2.

The second unit 3 of the securing apparatus 1 may be similar to the first unit 2 of the securing apparatus 1. More specifically, the second unit 3 may have a top side 20, a bottom side 21, a front 22, a back 23, a first side 24 and a second side 25. Further, the second unit 3 may have a plurality of slots 10 divided by a plurality of securing panels 11. The plurality of slots 10 and the plurality of securing panels 11 may be substantially planar and substantially parallel to each other. Further the exterior most plurality of securing panels 11 may be the first side 24 and the second side 25 of the second unit 3.

The first unit 2 and the second unit 3 may each have a length 42. Preferably, the length 42 of the first unit 2 and the second unit 3 are similar. The plurality of slots 10 (created by the spaces between the plurality of securing panels 11) may be may have a width 40 and a height 41. Further, the plurality of slots 10 (created by the spaces between the plurality of securing panels 11) may extend the entire length 42 of the first unit 2 and the second unit 3. The bottom of the first unit and the second unit may have a rigid surface 60 for grasping the planar surface 70, for example, via friction (See FIG. 3).

A carpenters square 50, or other substantially planer device, may be inserted into one of the plurality of slots 10 located on the first unit 2. The width 40 of the plurality of slots 10 may be slightly larger than a width 55 of a standard carpenter's square 50. As a result, the carpenter's square 50 may fit snugly within one of the plurality of slots 10 of the first unit 2 and the second unit 3. Further, the carpenter's square 50 may be temporarily secured into one of the plurality of slots 10 by, for example, friction.

Figure 4:
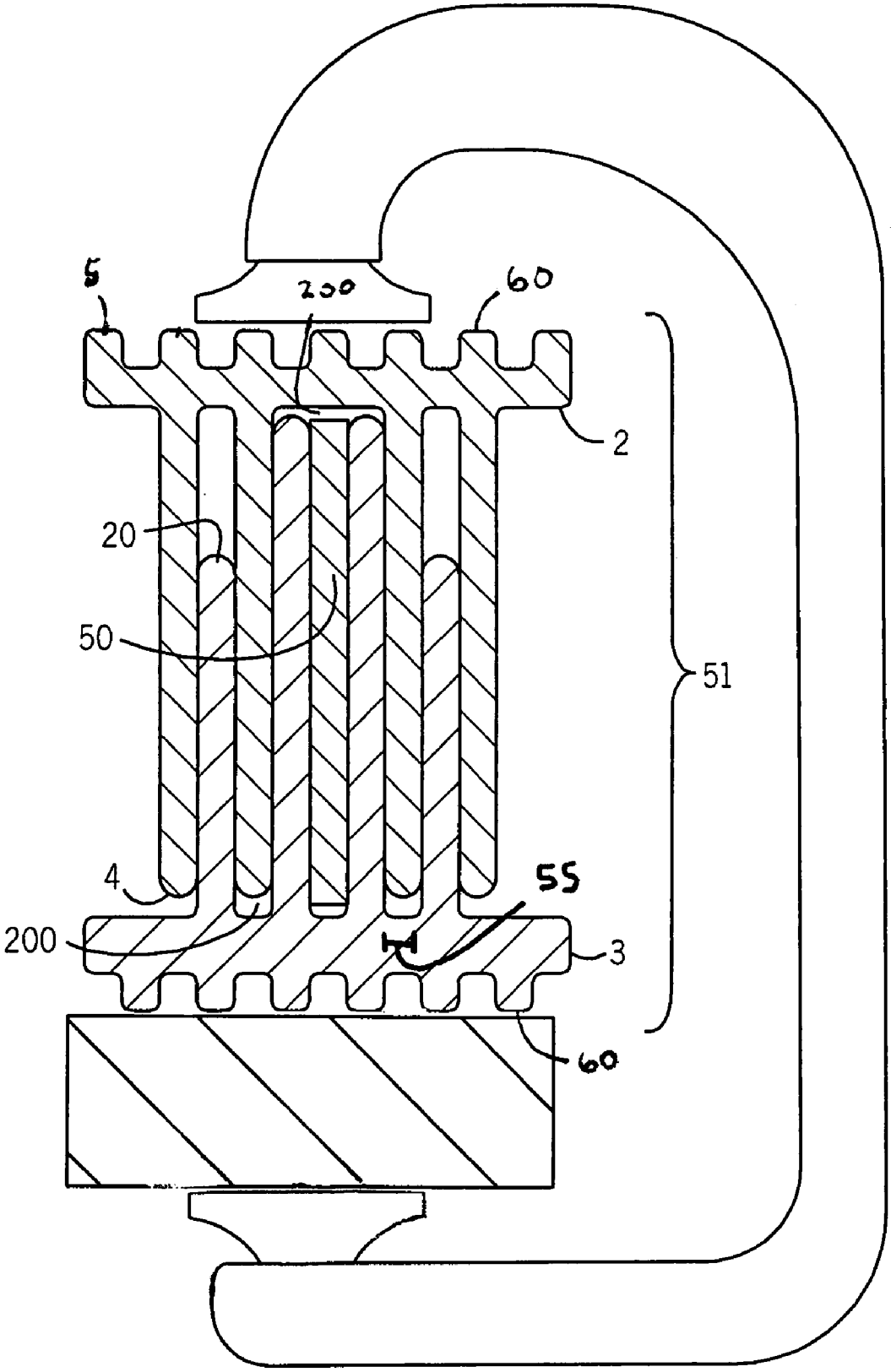
FIG. 4 illustrates a side flat view of the present invention in use.

The first unit 2 and the second unit 3 of the securing apparatus 1 together may form a single block-like structure 51 (FIG. 4). While using the securing apparatus 1, the user may use multiple block-like structures 51, depending on, for example, the length of the carpenter's square 50 or other factors.

Figure 3:
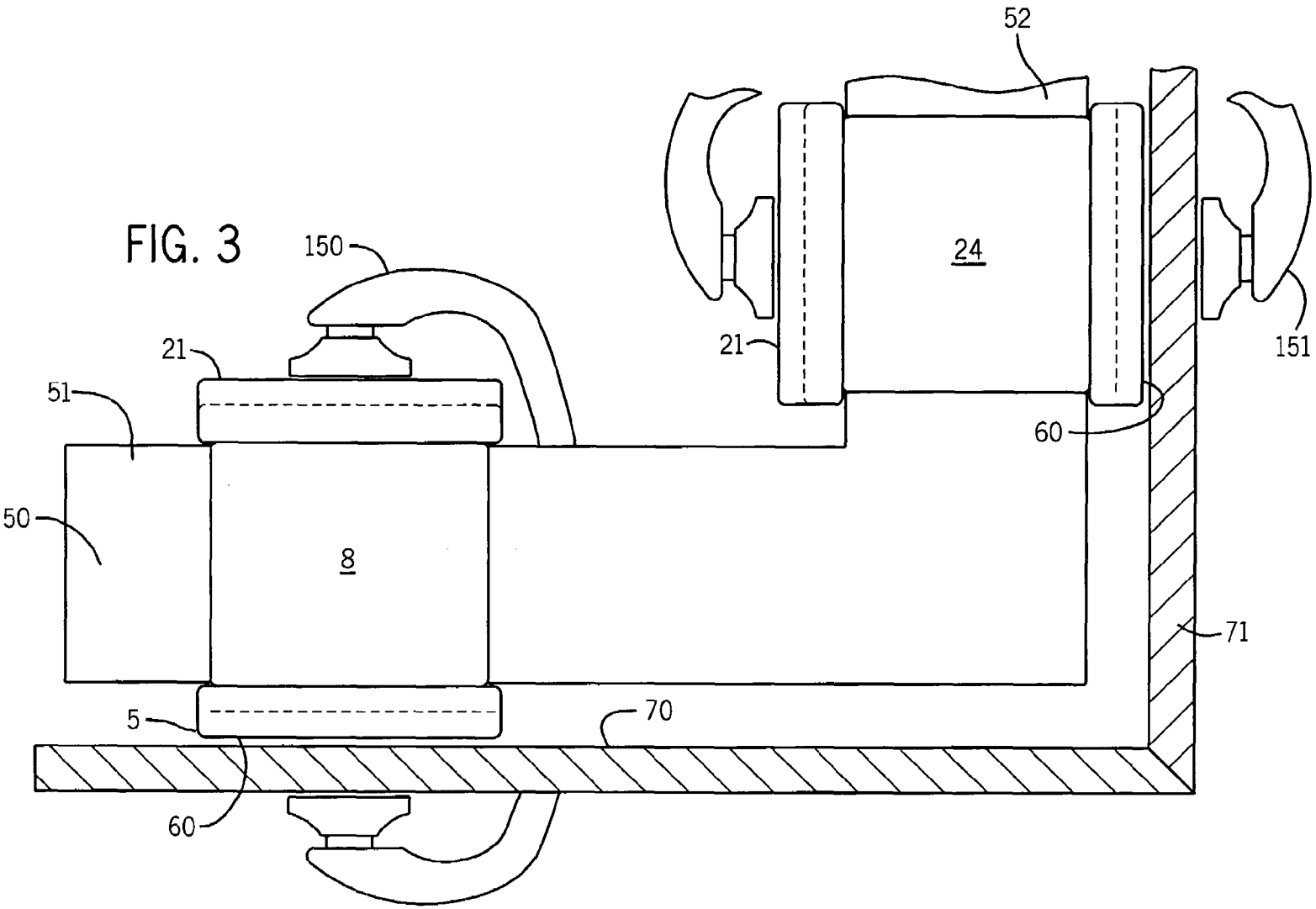
FIG. 3 illustrates a front flat view of the securing apparatus wherein a first unit and a second unit are securing a carpenters square to a planar surface.

Referring now to FIG. 3, in practice the user places the bottom side 5 of the first unit 2 on top of a first planar surface 70. If a long carpenter's square 50 is used the user may place multiple first units 2 on top of the first planar surface 70. If multiple first units 2 (and corresponding second units 3) are used to secure the carpenter's square 50 the plurality of slots 10 should be lined up so as to allow the carpenter's square 50 to be inserted into the plurality of slots 10 located in different first units 2. In practice, the user may simply place the multiple first units 2 onto the carpenter's square 50 and then secure the carpenter's square 50-securing apparatus 1 unit to the planar surface 70.

A center slot 200 of the first unit 2 may have a larger width 201 than the remaining slots 10 of the first unit 2 and the second unit 3. More specifically, the larger width 201 of the first unit 2 may be roughly equal to the width 55 of the carpenter's square 50 plus the width of two of the plurality of securing panels 11 of the second unit 3. Therefore, the center slot 200 of the first unit 2 may snugly fit the carpenter's square 50 and two of the plurality of securing panels 11 of the second unit 3.

After one or more first units 2 are placed on the first planar surface 70, the carpenter's square 50 is placed, preferably, into the center slot 200 of the plurality of slots 10. Next, the second unit 3 is secured onto the first unit 2 and the carpenter's square 50. More specifically, the second unit 3 is inserted over the carpenter's square 50 and the first unit 2 in an inverted position. The top side 20 of the second unit 3 overlaps the top side 4 of the first unit 2 so that a portion of the carpenter's square 50 is completely surrounded by the interlocking first unit 2 and second unit 3. More specifically, a portion of the carpenter's square 50 is completely located with a space created by one of the plurality of slots 10 for the first unit 2 and one of the plurality of slots 10 of the second unit 3. The carpenter's square 50 may be secured within the first unit 2 and second unit 3 by, for example, friction.

The plurality of slots 10 located on the first unit 2 which do not accept carpenter's square 50 (namely, the non-center slots) may be used to accept the corresponding plurality of securing panels 11 of the second unit 3, and vice versa. The first unit 2 may be secured to the second unit 3 as a result of the friction created by the multiple plurality of panels 11 being inserted into the plurality of slots 10.

Once the first unit 2 and second unit 3 are secured to each other and around the carpenter's square 50, the bottom side 5 of the first unit 2 and the bottom side 21 of the second unit 3 may allow the generally thin carpenter's square 50 to stand upright without falling over. Further, the bottom side 5 of the first unit 2 and the bottom side 21 of the second unit 3 may provide the user with a generally flat surface for a clamp 150 to grasp onto to secure the carpenter's square 50 to the planar surface 70.

A carpenter's square 50 is generally L-shaped and generally has a first arm 51 and a second arm 52. After the first unit 2 and the second unit 3 are inserted around the first arm 51 of the carpenter's square 50 a second first unit 2 and second unit 3 may be inserted around the second arm 52 of the carpenter's square 50. A second clamp 151 may then be used to clamp the first unit 2, second unit 3 and carpenter's square 50 to a second planar surface 71.

Typically, an end of the first planar surface 70 and an end of the second planar surface 71 are placed together and glue, nails and or screws are used to permanently secure the first planar surface 70 to the second planar surface 71. Once the glue dries, the clamps 150 and 151 may be removed allowing the user to completely remove the first unit 2, second unit 3 and the carpenter's square 50 from both planar surfaces. The first unit 2 and second unit 3 may then be pulled away from the carpenter's square 50 by, for example, overcoming the friction holding the units together. The first unit 2, second unit 3 and carpenter's square 50 may then be stored and used again.

In an embodiment, each of the first unit 2 and the second unit 3 only have one slot 10, instead of the plurality of slots 10 as described above.

Although embodiments of the present invention are shown and described therein, it should be understood that various changes and modifications to the presently preferred embodiments will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A securing apparatus for a planar surface comprising:

a first unit having a top side, a bottom side, a front side, a back side, a width, and a length;

a plurality of securing panels having a uniform height located substantially perpendicular with respect to the front side and back side of the first unit on the first unit wherein the securing panels extend the entire length of the first unit, wherein said securing panels have a space therebetween and a space with an different width on opposite sides on said securing panels;

a second unit having a top side, a bottom side, a front side, a back side, a width, and a length; and a plurality of securing panels having a uniform height located substantially perpendicular with respect to the front side and back side of the second unit wherein the securing panels of the second unit extend the entire length of the second unit with each said panel having a different height and wherein the securing panels of the first unit receives a portion of a securing panel of the second unit such that a portion of a securing panel of the second unit is secured between at least two securing panels of the first unit and further wherein a portion of an object being stabilized is completely surrounded by panels of the first unit and second unit.

2. The securing apparatus of claim 1 further comprising: a plurality of slots on the first unit.

3. The securing apparatus of claim 1 further comprising: a plurality of slots on the second unit.

4. The securing apparatus of claim 1 wherein a space between two securing panels of the first unit is larger than a space between two securing panels of the second unit.

5. The securing apparatus of claim 1 further comprising: a rigid surface on the bottom of the first unit and second unit.

6. The securing apparatus of claim 1 wherein the first unit is secured to the second unit by friction.

7. The securing apparatus of claim 1 wherein a clamp is used to secure the apparatus to a planar surface.

* * * * *